US005906228A

United States Patent [19]

Keller

[11] Patent Number: 5,906,228

[45] Date of Patent: May 25, 1999

[54] GASOLINE DISPENSING SYSTEM AND METHOD WITH RADIO FREQUENCY CUSTOMER IDENTIFICATION ANTENNA

[75] Inventor: Timothy Robert Keller, Salisbury, Md.

[73] Assignee: Dresser Industries, Inc., Dallas, Tex.

[21] Appl. No.: 08/936,263

[22] Filed: Sep. 24, 1997

[51] Int. Cl.[6] ..... B65B 1/04

[52] U.S. Cl. ..... 141/94; 141/351; 343/892; 343/867

[58] Field of Search ..... 141/94, 192, 351; 343/892, 867; 222/71

[56] References Cited

U.S. PATENT DOCUMENTS

| | | | |
|---|---|---|---|
| 3,369,247 | 2/1968 | Bacow | 343/892 |
| 4,263,945 | 4/1981 | Van Ness . | |
| 4,469,149 | 9/1984 | Walkey et al. . | |
| 4,804,969 | 2/1989 | Blaese | 343/892 |
| 4,934,419 | 6/1990 | Lamont et al. . | |
| 4,967,366 | 10/1990 | Kaehler . | |
| 4,972,198 | 11/1990 | Feltz et al. | 343/867 |
| 5,204,819 | 4/1993 | Ryan . | |
| 5,249,612 | 10/1993 | Parks et al. | 141/94 |
| 5,359,522 | 10/1994 | Ryan . | |
| 5,383,500 | 1/1995 | Dwars et al. . | |
| 5,605,182 | 2/1997 | Oberrecht et al. . | |

*Primary Examiner*—Steven O. Douglas
*Attorney, Agent, or Firm*—Haynes and Boones, LLP

[57] ABSTRACT

A dispensing system and method utilizing a break-away antenna in a radio frequency customer identification system for service stations to reliably and accurately identify and charge customers for their purchases. The antenna is formed by a bracket adapted to be affixed to the object, a rod pivotally mounted to the bracket, and a spring normally urging the rod to a first position, the rod being pivotal to a second position in response to a force applied to the rod in a direction towards the second position.

13 Claims, 3 Drawing Sheets

10
20
22
12
14a
16a
16b
16c
12a
12b
12c
14b
14c

GASOLINE DISPENSING SYSTEM AND METHOD WITH RADIO FREQUENCY CUSTOMER IDENTIFICATION ANTENNA

BACKGROUND OF THE INVENTION

The present invention relates to gasoline dispensers and, more particularly, to gasoline dispensers that use an antenna to receive radio frequency identification signals from a customer's vehicle to automatically identify the customer, authorize the sale of products or services to the customer, and to subsequently bill the customer's charge account for the products or services. The present invention is particularly useful in a service station environment where customers may purchase fuel for their vehicles, obtain a car wash, or purchase other items such as food, drinks, or sundries from a convenience store, or drive-through window, that may be located on the premises.

Typically, when a customer purchases fuel at a service station, the customer presents payment, in the form of cash or credit/debit card, to the service station attendant either before or after fueling. The attendant must control the activation of the dispenser to allow fueling. If payment is required before fueling may begin, the attendant must activate a switch, typically near the cash register, in order to unlock the dispenser to allow fueling to begin. Once fueling has been completed and the dispenser nozzle has been returned to its seat, the attendant manually resets the dispenser again through activation of a switch at the cash register.

In order to improve efficiency in the payment process, many service stations are now equipped with credit/debit card readers at the dispensers for direct use by the customer. In these arrangements, customer-activated-terminals are provided, each having a card reader, a display which displays messages to the customer, a key pad for use by the customer to make fueling and payment selections, a printer for printing receipts, and individual price displays corresponding to the individual fuel dispensing nozzles of the dispenser.

U.S. Pat. No. 5,072,380 issued to Robert E. Randelman et al. takes this payment automation one step further by disclosing an automatic vehicle recognition and customer billing system that may be used in a service station environment. The system automatically recognizes vehicles and correlates the purchase of products and services with the vehicle. The system of the '380 patent includes an antenna embedded in the ground near a gasoline dispensing pump. The antenna is connected to a controller located in a housing near the antenna. The controller controls the output of a radio frequency signal from the antenna and can detect an RF input signal. The antenna is always energized and, therefore, creates an electromagnetic field at a predetermined radio frequency in the fueling area. The system of the '380 patent also includes an emitter (or card) affixed to a vehicle. The card comprises an RF coil and integrated circuit component. When the card crosses the electromagnetic field, the electromagnetic field energizes the card. The activated card then emits an encoded electromagnetic pulse signal. The controller receives the signal and converts it into a data bit stream. A computer receives the data bit stream from the controller and in turn utilizes the data for displaying information on the pump display, for controlling the fuel dispenser, and for billing purposes.

One disadvantage of the '380 patent is that the antenna which emits the electromagnetic field is embedded in the ground near the fuel dispenser. The installation of such an antenna (or antennas where there is more than one dispenser) can be costly and can create a fire hazard from fueling spills or leaks from the fuel storage tanks typically located under ground near the fuel dispensers. Furthermore, where multiple dispensers are present and therefore multiple antennas and controllers are present, the system does not adequately prevent a vehicle card from being activated by more than one antenna at a time and detected by more than one controller at a time, such as may happen where antennas are positioned near each other and therefore interfere with one another. Furthermore, the system does not prevent the inadvertent detection of vehicle cards not intended to be used in a fueling transaction.

Another disadvantage of the '380 patent is in connection with service stations that provide for separate fueling from both sides of a dispenser and/or from several closely-spaced rows of dispensers. With the system of the '380 patent applied to such a dispenser arrangement, the vehicle card of a vehicle stopped between antennas may be detected by the wrong controller, i.e., one not associated with the dispenser where the vehicle is actually receiving fuel, or may wrongly be detected by a controller, i.e., where the vehicle is stopped near an antenna but is not fueling.

Other automatic identification systems exist that employ radio frequency technology. For example, Texas Instruments Incorporated of Dallas, Tex., markets a number of radio frequency identification systems referred to commercially as its TIRIS™ (Texas Instruments Registration and Identification Systems) product line. The TIRIS™ product line includes radio frequency transponders (read-only as well as read-write) that may be low frequency or high frequency in their operation and which may be attached to or embedded in objects or may be hand-held. Readers, through antennas, send out radio frequency waves to the transponders, and the transponders broadcast stored data back to the reader for processing. One suggested application of the TIRIS™ product line is a fuel dispensing system (where a transponder is mounted beside the vehicle's fuel tank and a transceiver is mounted on the fuel dispensing nozzle). The fuel dispensing system application, however, is not desirable because maintenance of the fuel dispensing nozzle with the transceiver can present a service problem as well as a replacement problem and, furthermore, the location of the transponder and transceiver can create a fire hazard.

Copending U.S patent application Ser. No. 08/768,723 is assigned to the assignee of the present invention and solves these problems by providing a radio frequency customer identification system and method which determines whether a transponder containing customer identification data is within range of a gasoline dispenser. The dispenser is designed to require activation by the customer to initiate a transaction, and an antenna is associated with each dispensing area of the dispenser and is mounted to the tops of the dispensers. Readers housed in the dispensers send radio frequency power pulses to the antennas which in turn direct the power pulses to create electromagnetic fields. The antennas are optimally positioned so that the electromagnetic fields cover predetermined areas near the dispenser.

The antennas also pick-up customer identification data that is broadcast by the transponders. In particular, if a vehicle-mounted transponder enters the electromagnetic field created by a long-range antenna, the vehicle-mounted transponder will become activated and broadcast its customer identification ("CID") code. The antenna detects the CID code and sends the code to the associated reader for decoding and processing. A processor is connected to the reader and to the dispenser for associating customer identification data received at the dispensing area with a transaction at the dispenser, whereupon the transaction at the dispenser is charged to the customer according to the customer identification data. The disclosure of this patent application is incorporated by reference.

The arrangement disclosed in this patent application overcomes the above-noted problems with the prior art by providing a reliable, safe, customer-friendly identification system that can automatically identify customer purchasing services or products at a service station, and bill the customer's account for any purchases made.

However, the design of the above-described antenna used in the system disclosed in the patent application is such that it must project laterally from its respective dispenser, and, as such, is susceptible to being struck by vehicles as they pass by the dispenser. If this occurs, the antenna can be severely and permanently damaged, often requiring shut down of the dispenser while the antenna is replaced.

SUMMARY OF THE INVENTION

The dispensing system and method of the present invention, accordingly, utilizes a antenna in a radio frequency customer identification system for service stations to reliably and accurately identify and charge customers for their purchases.

To this end, the antenna of the present invention includes a bracket adapted to be affixed to the object, a rod pivotally mounted to the bracket, and a spring normally urging the rod to a first position, the rod being pivotal to a second position in response to a force applied to the rod in a direction towards the second position.

The antenna of the present invention can thus survive being struck by a vehicle as it passes by the dispenser and, in fact, can remain operable. This, of course, eliminates the high parts and labor costs associated with a shut-down of the dispenser in the event that the antenna is permanently damaged.

DETAILED DESCRIPTION OF THE PREFERRED EMBODIMENT

Figure 1:
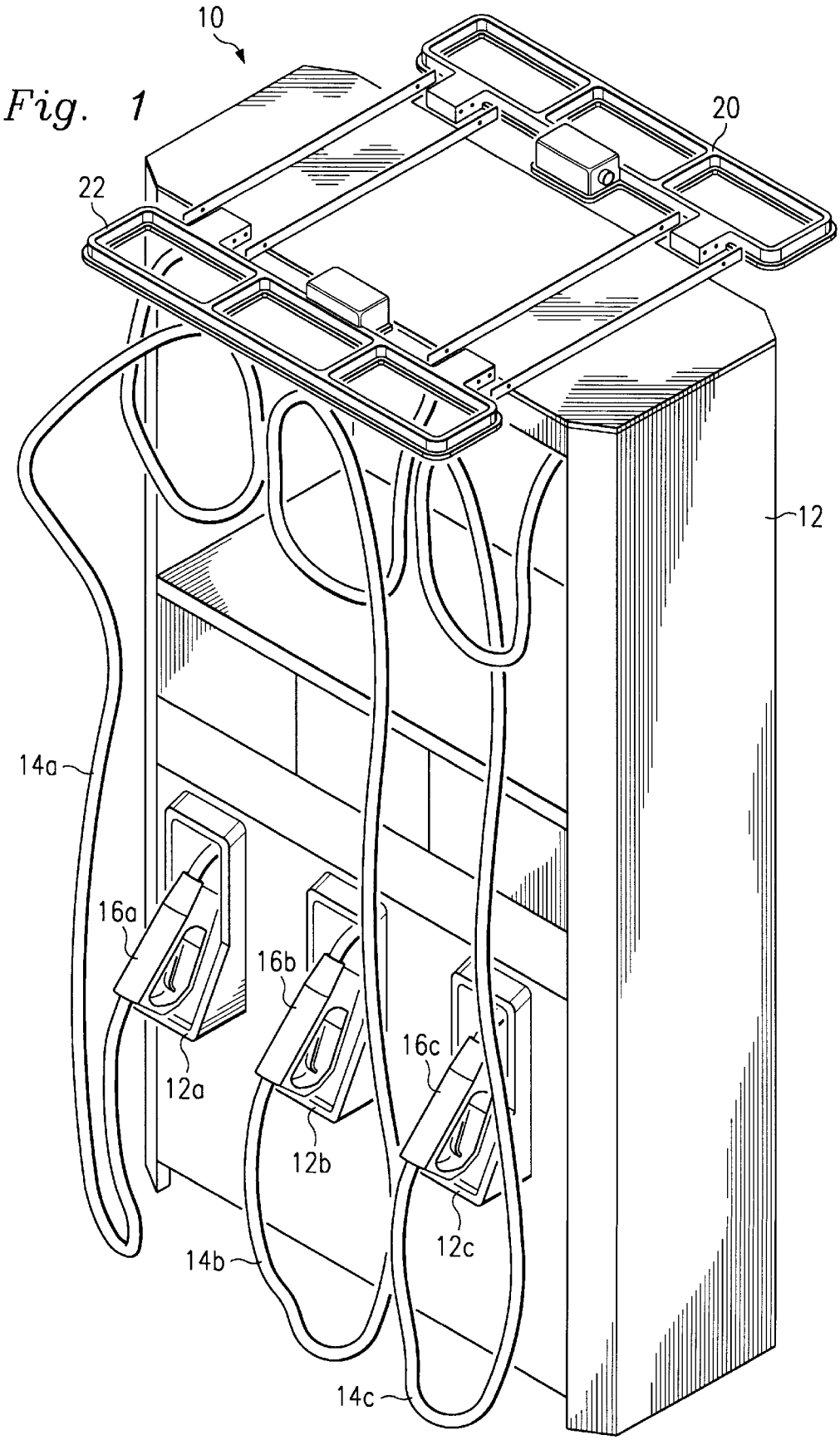
FIG. 1 is an isometric view of a gasoline dispenser having two antennas of the present invention mounted thereto.

Referring to FIG. 1 of the drawing, the reference numeral 10 refers, in general, to a gasoline dispenser, including a housing 12 for receiving stored gasoline from an underground storage tank (not shown) and for selectively dispensing the gasoline to vehicles. Each side of the housing 12 forms a dispensing station with a station on one side of the housing being shown in FIG. 1. Three hose assemblies 14*a*–14*c* are provided at each station which, in turn, have dispensing nozzles 16*a*–16*c*, respectively, affixed to one end thereof. Although not shown in the drawings for the convenience of presentation, it is understood that one or more pumps and flow meters are provided for pumping, and metering the flow of, the gasoline as it flows from the storage tank, through the dispenser 12, and to the nozzles 16*a*–16*c* for dispensing into the fuel tanks of vehicles being serviced. To this end, three conduits (not shown) would be provided in the interior of the housing 12 for connecting the underground tank to the hose assemblies 14*a*–14*c*.

It is also understood that each hose assembly 14*a*–14*c* includes two hoses connected to their respective dispensing nozzles 16*a*–16*c* for respectively dispensing the gasoline through one of the hoses and for receiving the displaced vapor/air mixture from the vehicle tank in the other hose, as will be described.

The housing 12 is provided with three boots, or receptacles, 12*a*–12*c* for receiving the nozzles 16*a*–16*c* during non-use and, although not shown, it is understood that conventional switches, displays, and the like are also provided on the housing. It is also understood that the station provided on the other side of the housing 12 is identical to the station just described and that, in a normal installation, several dispensers, identical to the dispenser 10, would be provided.

Two antennas 20 and 22 are mounted to the top of the housing 12 in a manner to be described, and project laterally from the respective sides of the housing. The antenna 20 is shown in detail in FIG. 2, it being understood that the antenna 22 is constructed and functions in the same manner. The antenna 20 is formed by a rod 24 formed into a rectangular, closed configuration having two spaced cross-members 24*a* and 24*b* for stiffening purposes. The antenna 20 is preferably formed by an injection molded plastic material with a plurality of loop wires embedded therein in a conventional manner.

Two spaced mounting flanges 26 and 28 extend from one side of the antenna 20 and preferably are formed integrally with the rod 24. A housing 29 is also formed integrally with the rod 24 and extends between the mounting flanges 26 and 28. The housing 29 contains a ferrite tuning board and/or rod (not shown) for tuning the antenna in a conventional manner. A terminal 29*a* is affixed to a side wall of the housing 29 receiving an antenna cable (not shown).

Two mounting brackets 30 and 32 are fastened to the top of the dispenser housing 12 near one side wall thereof, and are adapted to receive the mounting flanges 26 and 28, respectively. Since the mounting flanges 26 and 28 are identical, and since the mounting brackets 30 and 32 are identical, only the flange 26 and bracket 30 will be described in detail.

The bracket 30 projects outwardly from the corresponding side wall of the housing 12 and is formed by a flat plate 30*a* fastened to the upper surface of the dispenser housing 12 in any known manner. Two side walls 30*b* and 30*c* extend upwardly from the respective longitudinal edges of the plate 30*a*. A shaft, or bolt, 34 extends through aligned openings in the side walls 30*a* and 30*b* and through a bore formed in the flange 26 to pivotally mount the flange to the bracket. The diameters of the latter openings are larger than the diameter of the shaft 34 so that the flange can both pivot about the shaft 34 and move in an axial direction along the shaft. A portion of the projecting portion of the plate 30*a* is cut out so as to receive the flange 26 when it pivots, as will be described in detail.

Figure 2:
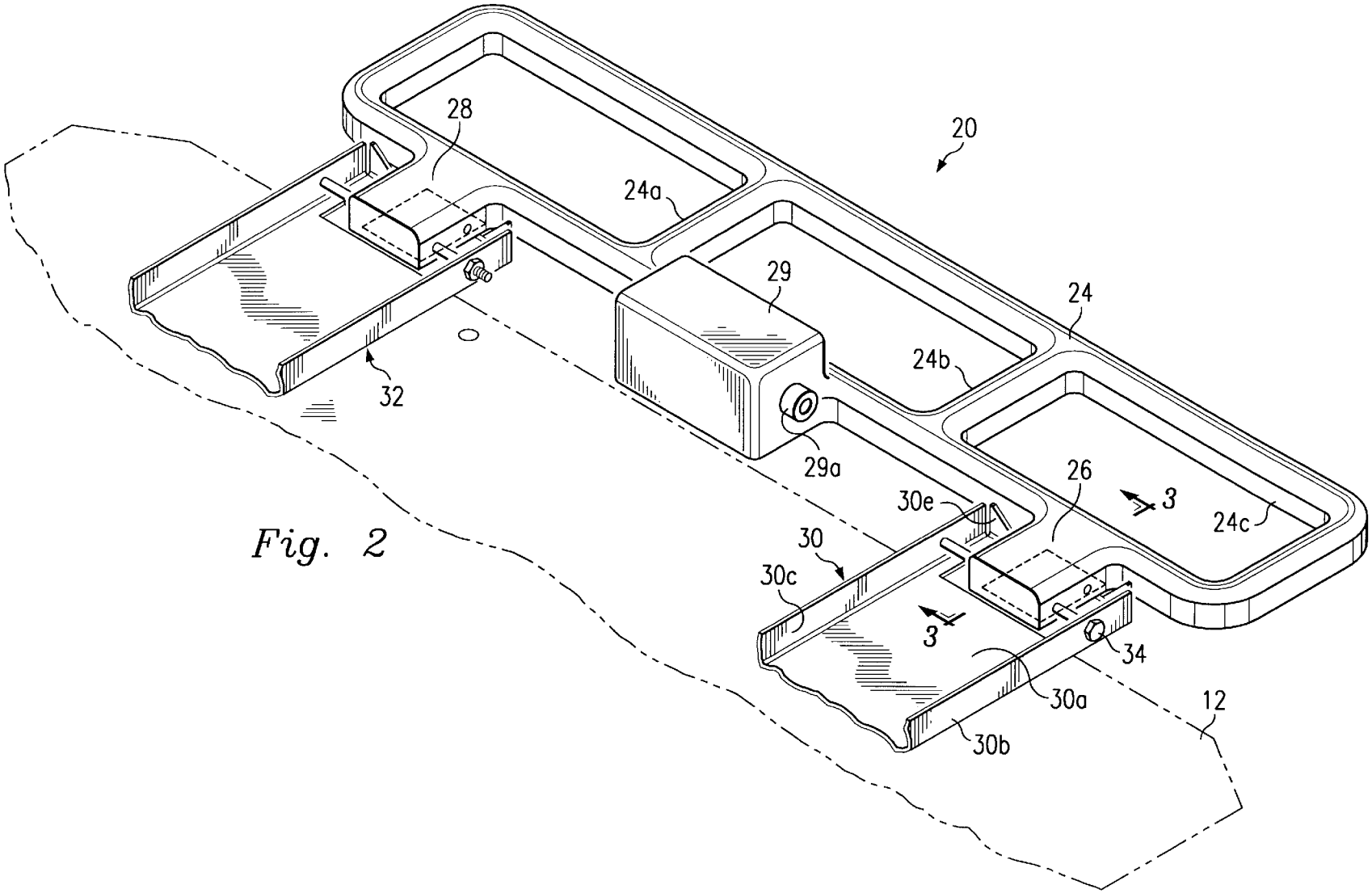
FIG. 2 is an enlarged isometric view of one of the antennas of FIG. 1.
Figure 3:
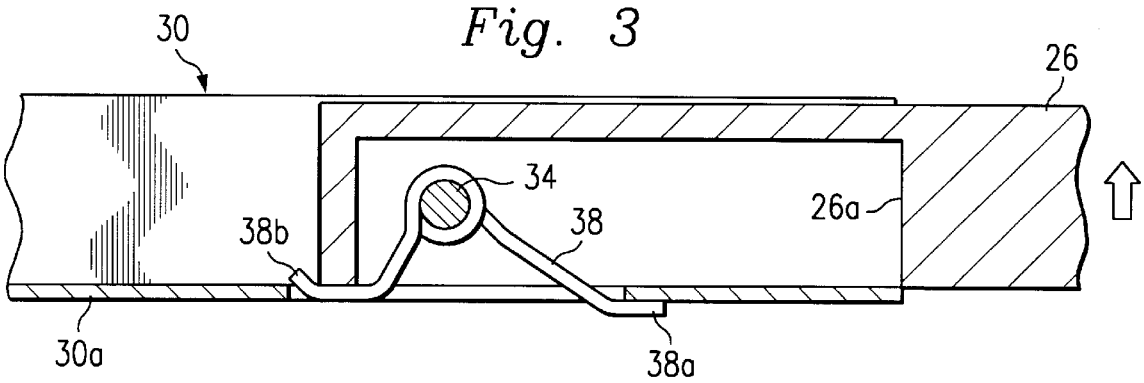
FIG. 3 is a sectional view taken along the line 3—3 of FIG. 2.

Referring to FIG. 3, a portion of the flange 26 is cut out to form an area 26*a* for receiving a leaf spring 38. An end portion 38*a* of the spring 38 engages the bottom of the plate 30*a* of the bracket 30, and the other end portion of the spring engages the lower end portion of the flange 26. An intermediate portion of the spring 38 is wrapped around the shaft 34 to apply a spring tension to the flange 26 to urge it to the horizontal position shown in FIGS. 1–3. The design of the spring 38 is such that it will permit pivotal movement of the flange 26 in response to a force acting against the rod 24 in a vertical direction as shown by the arrow in FIG. 3, and will return the flange to its normal horizontal position shown in FIG. 3 when the force is released.

Figure 4A:
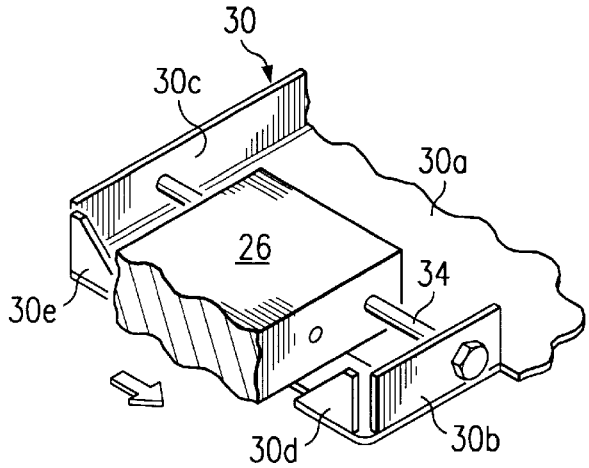
FIGS. 4A and 4B are enlarged views of a portion of a mounting bracket for mounting an antenna of FIG. 1 and 2 to the dispenser of FIG. 1, with the bracket and the antenna being rotated 180 degrees from FIG. 2.
Figure 4B:
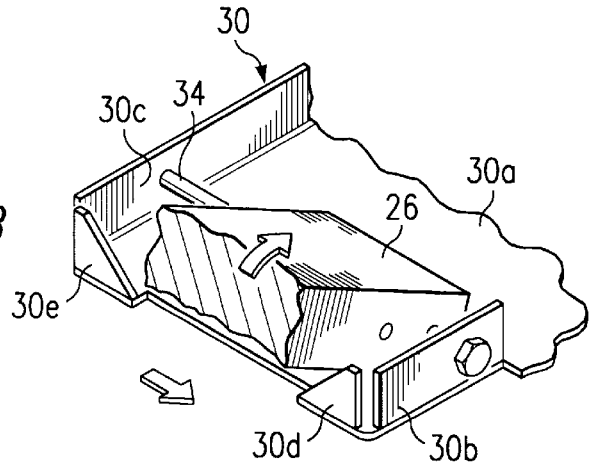

As better shown in FIGS. 4A and 4B, two spaced, beveled ramps 30*d* and 30*e* are formed at the end of the bracket 30 and are tapered downwardly from the side walls 30*b* and 30*c* respectively. Therefore, if the rod 24 is subjected to a lateral force in a horizontal plane in the direction shown by the arrow in FIG. 4A for example, the flange 26 would move in the same direction along the shaft 24 until it engages the ramp 30*d*. Further movement of the flange 26 in this direction causes the flange to ride up the ramp 30*d* thus imparting a vertical component to the flange's movement, as shown in FIG. 4B. This causes the flange 26 to pivot about the shaft 34 towards a vertical position as discussed above. Of course, the flange 26 can also move in a direction opposite that of the arrow in FIG. 4B in which case it would ride up the ramp 30*e* with the same result.

As stated above, the flange 28 (FIG. 2) and the bracket 32 are identical to, and function in the same manner as, the flange 26 and the bracket 30 and therefore will not be described in detail. Also, the antenna 20 (FIG. 1) is identical to, and functions in the same manner as, the antenna 20 and therefore also will not be described in detail.

In operation, at least one reader (not shown) is housed in the dispenser 12 and sends radio frequency power pulses to the antennas 20 and 22, respectively, which, in turn, direct the power pulses to create electromagnetic fields which cover predetermined areas near the housing 12. The antennas 20 and 22 also pick-up customer identification data that is broadcast by transponders attached to a vehicle being serviced or carried by the customer. If a vehicle-mounted transponder enters the electromagnetic field created by either antenna 20 or 22, the transponder will become activated and broadcast its customer identification ("CID") code. The antenna detects the CID code and sends the code to the associated reader for decoding and processing as also described above. A processor is connected to the reader and to the dispenser for associating customer identification data received at the dispensing area with a transaction at the dispenser, whereupon the transaction at the dispenser is charged to the customer according to the customer identification data. Since these functions of the reader, the transponder and the processor, as well a description of the associated software, are described in detail in the above identified patent application they will not be described any further herein.

The antenna 20 is urged to its normal, horizontal position, as viewed in FIG. 2, by the spring 38 and by the spring (not shown) associated with the flange 28 and the bracket 32, which position is the optimum position for transmitting and receiving the signals in accordance with the foregoing. In the event the antenna 20 is subjected to a force having a vertical component shown by the arrow in FIG. 3, or a horizontal component in the direction shown by the arrow in FIG. 4*a* (or in a direction opposite to the latter arrow), the antenna will pivot upwardly to a substantially vertical position thus avoiding any damage to it. After the force is terminated, the antenna 20 will be urged back to its horizontal position by the spring 38 and by the spring (not shown) associated with the flange 28 and the bracket 32.

The antenna of the present invention can thus survive being struck by a vehicle as it passes by the dispenser and, in fact, can remain operable. Thus the high parts and labor costs associated with a shut-down of the dispenser in the event that the antenna is permanently damaged are avoided.

It is understood that variations may be made in the foregoing without departing from the scope of the invention. For example, the antenna 20 of the present invention can be mounted relative to a portion of the dispenser housing 12 other than the upper surface. Also, the present invention is not limited to the antenna 20 being normally in a horizontal position and pivotal to a vertical position. Rather, the antenna can normally be urged to a position in a first plane and pivotal to a plane extending at an angle to the first plane. Further, the antenna is not limited to use with a gasoline dispensing system, but can be placed in other environments within the scope of the invention.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A gasoline dispensing system comprising a dispenser for dispensing fuel to vehicles and comprising a housing, a nozzle extending from the housing for receiving gasoline from a storage tank and dispensing the gasoline into a vehicle tank, and a mounting bracket affixed to the housing; and an antenna for receiving transmitted customer identification information from the vehicle, the antenna comprising a rod pivotally mounted to the mounting bracket, and a member normally urging the rod to a first position, the rod being pivotal to a second position in response to a force applied to the rod in a direction towards the second position.

2. The system of claim 1 wherein the member is a spring that engages the mounting bracket and the rod and returns the rod to its first position after release of the force.

3. The system of claim 1 further comprising a shaft mounted on the bracket, and wherein the rod comprises at least one flange having an opening for receiving the shaft to pivotally mount the rod to the mounting bracket.

4. The system of claim 3 wherein the mounting bracket is movable in a lateral direction along the axis of the shaft in response to a force being applied to the rod in the lateral direction, and wherein the mounting bracket comprises a member for imparting the pivotal movement to the rod in response to application of the latter force.

5. The system of claim 1 wherein the mounting bracket is fastened to the upper surface of the housing and wherein the rod projects outwardly from a wall of the housing in the first position.

6. The system of claim 5 wherein the first position is horizontal and wherein the second position is vertical.

7. An antenna for mounting to an object, the antenna comprising a mounting bracket adapted to be affixed to the object, a shaft mounted on the bracket, a rod comprising at least one flange having an opening for receiving the shaft to pivotally mount the rod to the bracket, and a member normally urging the rod to a first position, the rod being pivotal to a second position in response to a force applied to the rod in a direction towards the second position.

8. The antenna of claim 7 wherein the member is a spring that engages the mounting bracket and the rod and returns the rod to its first position after release of the force.

9. The antenna of claim 7 wherein the rod is movable in a lateral direction along the axis of the shaft in response to a force being applied to the rod in the lateral direction, and wherein the bracket comprises a member for imparting the pivotal movement to the rod in response to application of the latter force.

10. The antenna of claim 7 wherein the bracket is fastened to a surface of the object and wherein the rod projects outwardly from the object in the first position.

11. The antenna of claim 10 wherein the first position is horizontal and wherein the second position is vertical.

12. A method of dispensing gas comprising the step of providing a dispenser equipped with a nozzle for insertion into the fuel tank of a vehicle, providing a transponder on the vehicle for transmitting customer identification information to the dispenser for processing, and mounting an antenna on the dispenser in a first position for receiving the transmitted information, and permitting the antenna to pivot to a second position in response to a force applied to the antenna in a direction towards the second position.

13. The method of claim 12 wherein the antenna returns to the first position after release of the force.

* * * * *